US008919897B2

(12) United States Patent
Chen et al.

(10) Patent No.: US 8,919,897 B2
(45) Date of Patent: Dec. 30, 2014

(54) SLIDE ASSEMBLY WITH DECELERATION DEVICE

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shun-Ho Yang, Kaohsiung (TW); Chih-Hsin Yeh, Kaohsiung (TW); Cheng-Chieh Weng, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 13/886,724

(22) Filed: May 3, 2013

(65) Prior Publication Data

US 2014/0327352 A1 Nov. 6, 2014

(51) Int. Cl.
*A47B 88/00* (2006.01)
*A47B 88/08* (2006.01)

(52) U.S. Cl.
CPC ..... *A47B 88/08* (2013.01)
USPC ..... 312/334.44

(58) Field of Classification Search
USPC ..... 312/333, 334.7, 334.8, 334.44, 334.46
See application file for complete search history.

(56) References Cited

U.S. PATENT DOCUMENTS

| | | | | |
|---|---|---|---|---|
| 4,469,384 | A * | 9/1984 | Fler et al. | 312/333 |
| 4,932,792 | A * | 6/1990 | Baxter | 384/18 |
| 5,181,782 | A * | 1/1993 | Wojcik | 384/21 |
| 5,316,389 | A | 5/1994 | Hoffman | |
| 6,145,944 | A * | 11/2000 | Bayani et al. | 312/334.44 |
| 6,244,678 | B1 * | 6/2001 | Dopp et al. | 312/333 |
| 6,254,210 | B1 * | 7/2001 | Parvin | 312/334.46 |
| 6,412,891 | B1 | 7/2002 | Liang et al. | |
| 6,824,233 | B2 * | 11/2004 | Chen et al. | 312/334.46 |
| 6,945,619 | B1 | 9/2005 | Chen et al. | |
| 7,980,641 | B2 | 7/2011 | Huang et al. | |
| 2002/0140331 | A1 * | 10/2002 | Chen et al. | 312/334.46 |
| 2003/0209958 | A1 * | 11/2003 | Hwang et al. | 312/334.46 |
| 2004/0174103 | A1 * | 9/2004 | Yang | 312/334.46 |
| 2009/0096340 | A1 * | 4/2009 | Chen et al. | 312/334.46 |

* cited by examiner

*Primary Examiner* — Matthew Ing
(74) *Attorney, Agent, or Firm* — Rosenberg, Klein & Lee

(57) ABSTRACT

A slide assembly includes a first rail, a second rail, a stop member and a friction member. The first rail includes two sidewalls with a connection wall connected therebetween. The second rail is slidably located between the two sidewalls of the first rail. The stop member is fixed to the connection wall and has a stop plate which is perpendicular to the connection wall. The friction member is fixed to the second rail and has an extension portion. The extension portion has a guide face. When the second rail is moved relative to the first rail after the friction member touches the stop plate and overlaps the stop member by the guide face, the friction member is slidably and flexibly in contact with the stop plate.

4 Claims, 5 Drawing Sheets

SLIDE ASSEMBLY WITH DECELERATION DEVICE

FIELD OF THE INVENTION

The present invention relates to a slide assembly, and more particularly, to a slide assembly with a deceleration device used for decelerating the speed of a moving rail of a slide assembly.

BACKGROUND OF THE INVENTION

The conventional slide assemblies with positioning devices for positioning rails, disclosed in U.S. Pat. No. 6,412,891 to Liang et al. and U.S. Pat. No. 6,945,619 to Chen et al., are referenced in the present invention. However, these two conventional slide assemblies of the prior art do not have a deceleration device so that when the rails is pulled to a desired position by a significant force, the positioning device generates impact noise, and/or the reliability of the positioning device is decreased.

The present invention intends to provide a slide assembly with a deceleration device used for slowing down the speed of the rail when the rail is pulled/extended to close to its fully extension position.

SUMMARY OF THE INVENTION

The present invention relates to a slide assembly with a deceleration device and comprises a first rail having two sidewalls and a connection wall is connected between the two sidewalls. A second rail is slidably connected to the first rail and located between the two sidewalls. A stop member is fixed to the connection wall and has a stop plate which is substantially perpendicular to the connection wall of the first rail. A friction member is fixed to the second rail and has an extension portion which is located corresponding to the stop plate of the stop member. The extension portion has a guide face formed therefrom. When the second rail is moved relative to the first rail after the friction member touches the stop plate and overlaps the stop member by the guide face, the extension portion of the friction member is slidably and flexibly in contact with the stop plate of the stop member so as to provide a friction between the friction member and the stop member.

Preferably, the extension portion has two opposite ends, and the guide surface is outwardly and downwardly bent from the extension portion and is formed from at least one of the ends of the extension portion.

Preferably, the extension portion has two opposite ends, and two guide surfaces are respectively outwardly and downwardly bent from the extension portion and are respectively formed from the two ends of the extension portion.

Preferably, the friction member has multiple extension portions.

Preferably, an engaging member is pivotably connected to the second rail, and a linkage member is movably connected to the second rail and located corresponding to the engaging member. The linkage member moves linearly to push the engaging member to swing.

Preferably, a resilient member contacts the engaging member to maintain the engaging member to be partially located corresponding to the stop plate of the stop member.

The primary object of the present invention is to provide a slide assembly with a deceleration device, wherein the slide speed of the rail is reduced when the rail is pulled to a fully extension position so as to reduce the impact force and noise.

Another object of the present invention is that when the user pulls the rail to the fully extended position, the deceleration device generates a resistance effect, so that the user can acknowledge that the rail is almost pulled to the fully extended position and hence adequately slow down the pulling speed of the rail.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
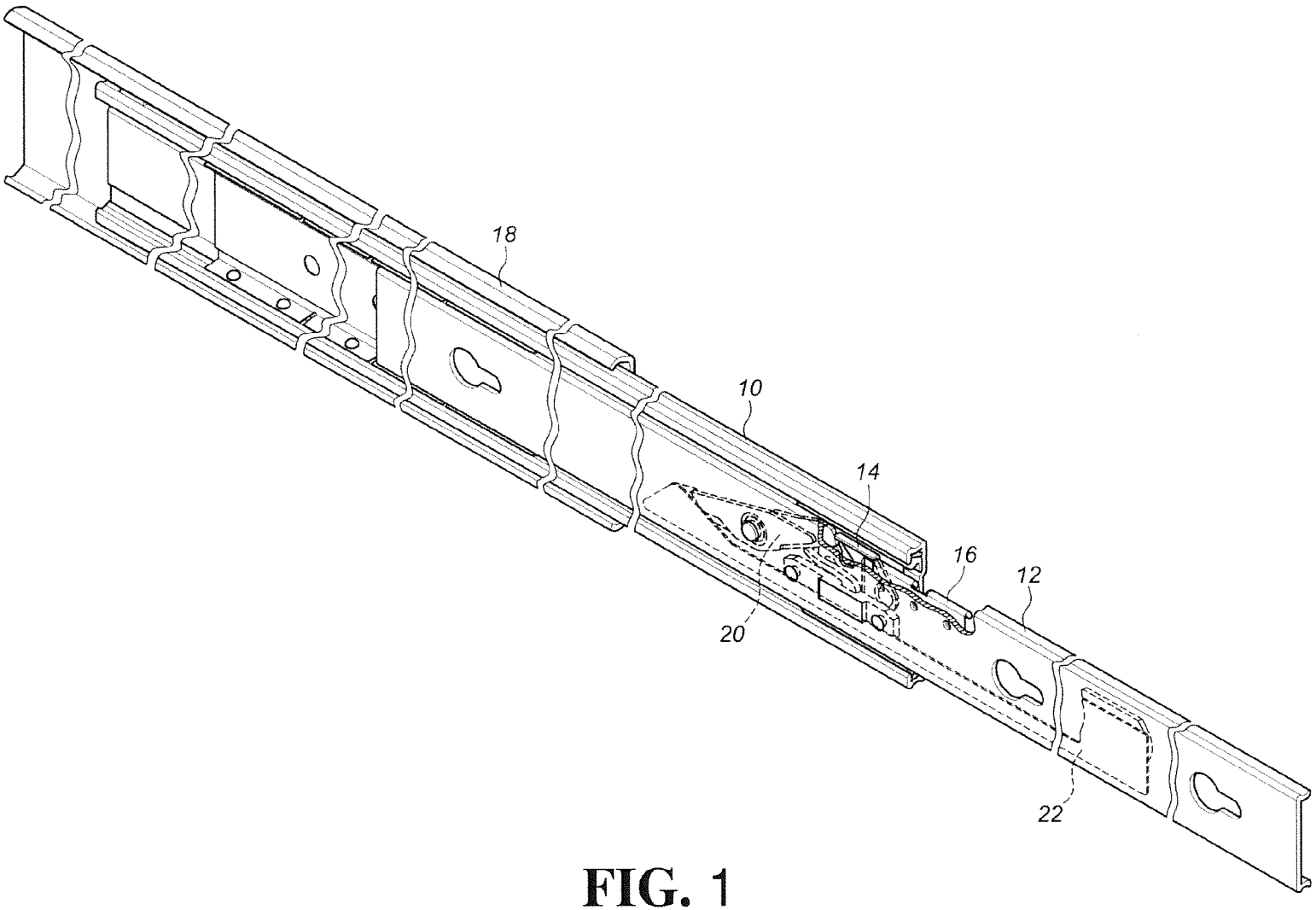
FIG. 1 is a perspective view to show the slide assembly of the present invention.
Figure 2:
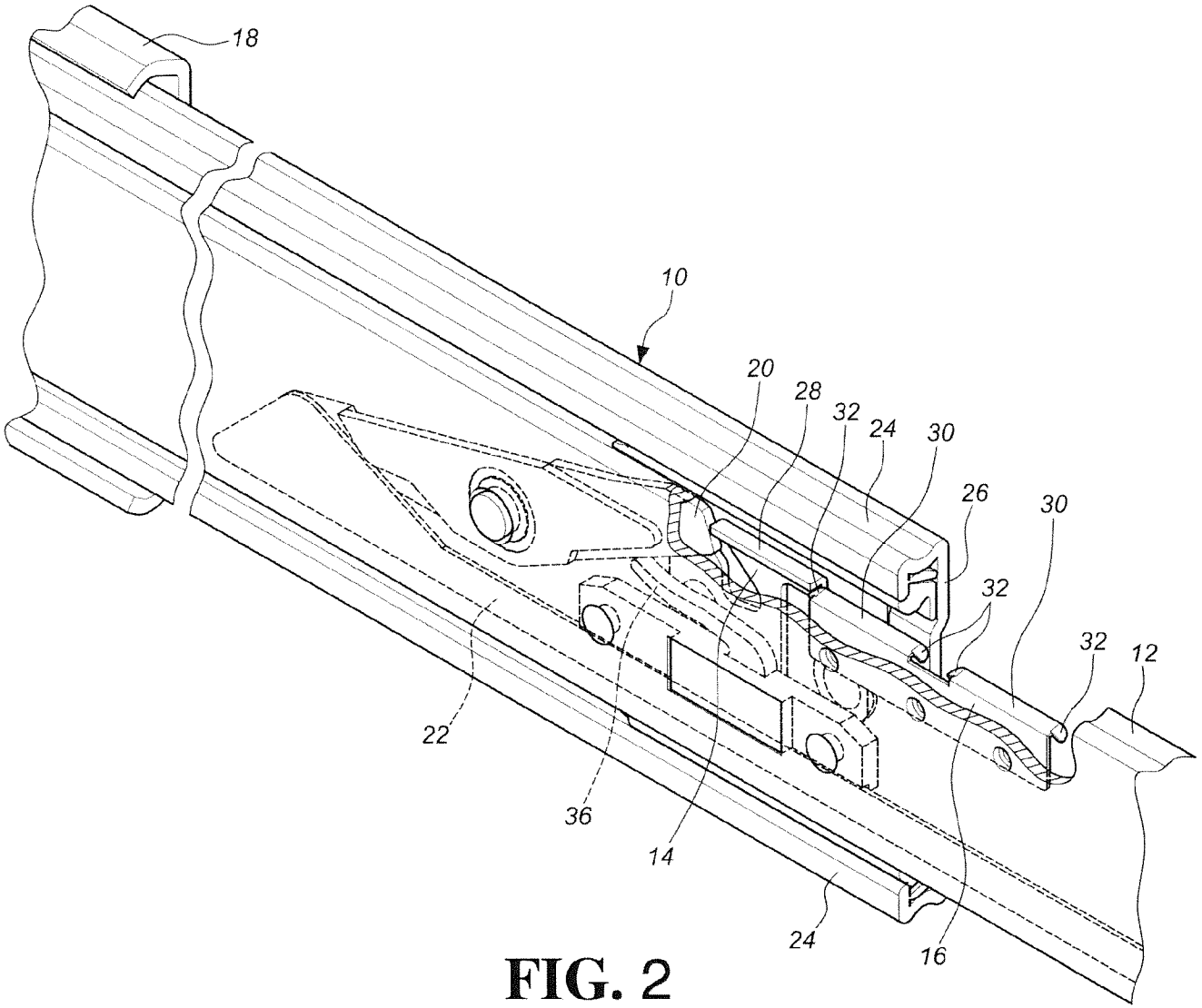
FIG. 2 shows that the slide assembly is positioned at the fully extension position.

Referring to FIGS. 1 and 2, the slide assembly of the present invention comprises a first rail 10, a second rail 12, a stop member 14, a friction member 16, a third rail 18, an engaging member 20 and a linkage member 22.

The first rail 10 comprises two sidewalls 24 and a connection wall 26, wherein the connection wall 26 is connected between the two sidewalls 24.

The second rail 12 is slidably connected to the first rail 10 and located between the two sidewalls 24.

The stop member 14 is fixed to the connection wall 26 of the first rail 10 and has a stop plate 28, wherein the stop plate 28 is substantially perpendicular to the connection wall 26 of the first rail 10.

The friction member 16 is fixed to the second rail 12 and has an extension portion 30 which is located corresponding to the stop plate 28 of the stop member 14 and has two opposite ends. The extension portion 30 has a guide face 32 formed thereon and corresponding to the stop plate 28. Preferably, the guide face 32 is outwardly and downwardly formed from one of the ends of the extension portion 30 so as to guide and bent the extension portion 30 to slidably and flexibly contact with the stop plate 28. Preferably, each end of the extension portion 30 having a guide face 32. In this embodiment, the friction member 16 has multiple extension portions 30.

The first rail 10 is slidably connected to the third rail 18 so as to form a three-section rail assembly.

The engaging member 20 is pivotably connected to the second rail 12. Preferably, a resilient member 36 contacts the engaging member 20 to maintain the engaging member 20 to be partially located corresponding to the stop plate 28 of the stop member 14, such that the engaging member 20 engages with the stop plate 28 when the second rail 12 is pulled to a fully extension position.

The linkage member 22 is movably connected to the second rail 12 and located corresponding to the engaging member 20. The linkage member 22 moves linearly to push the engaging member 20 to swing to release the engagement between the engaging member 20 and the stop member 14, so that the second rail 12 can be further pulled from the first rail 10 from an extended position and disengaged from the first rail 10.

Figure 3:
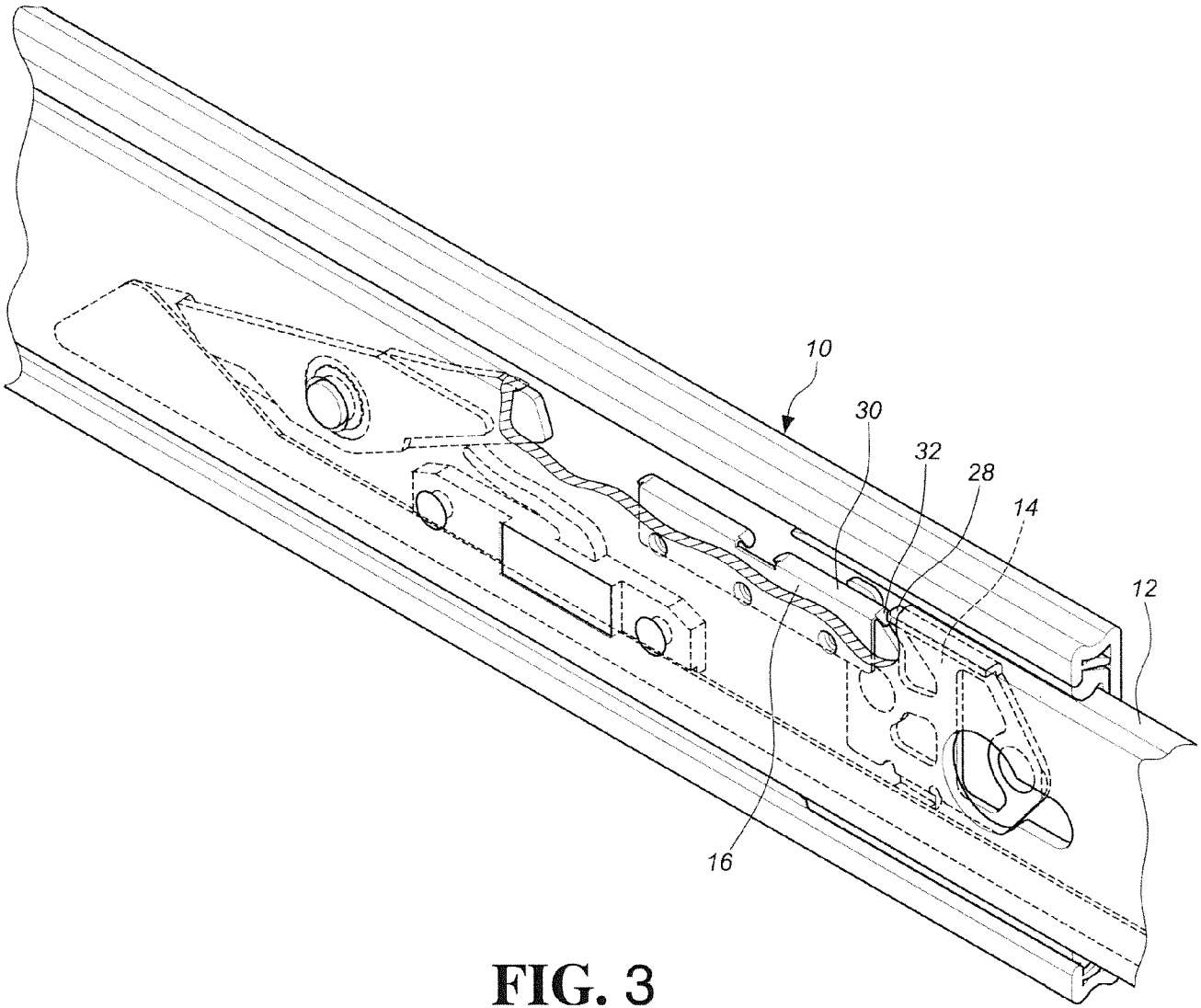
FIG. 3 shows that the deceleration device is at the first position where the guide face firstly touches the stop plate.
Figure 4:
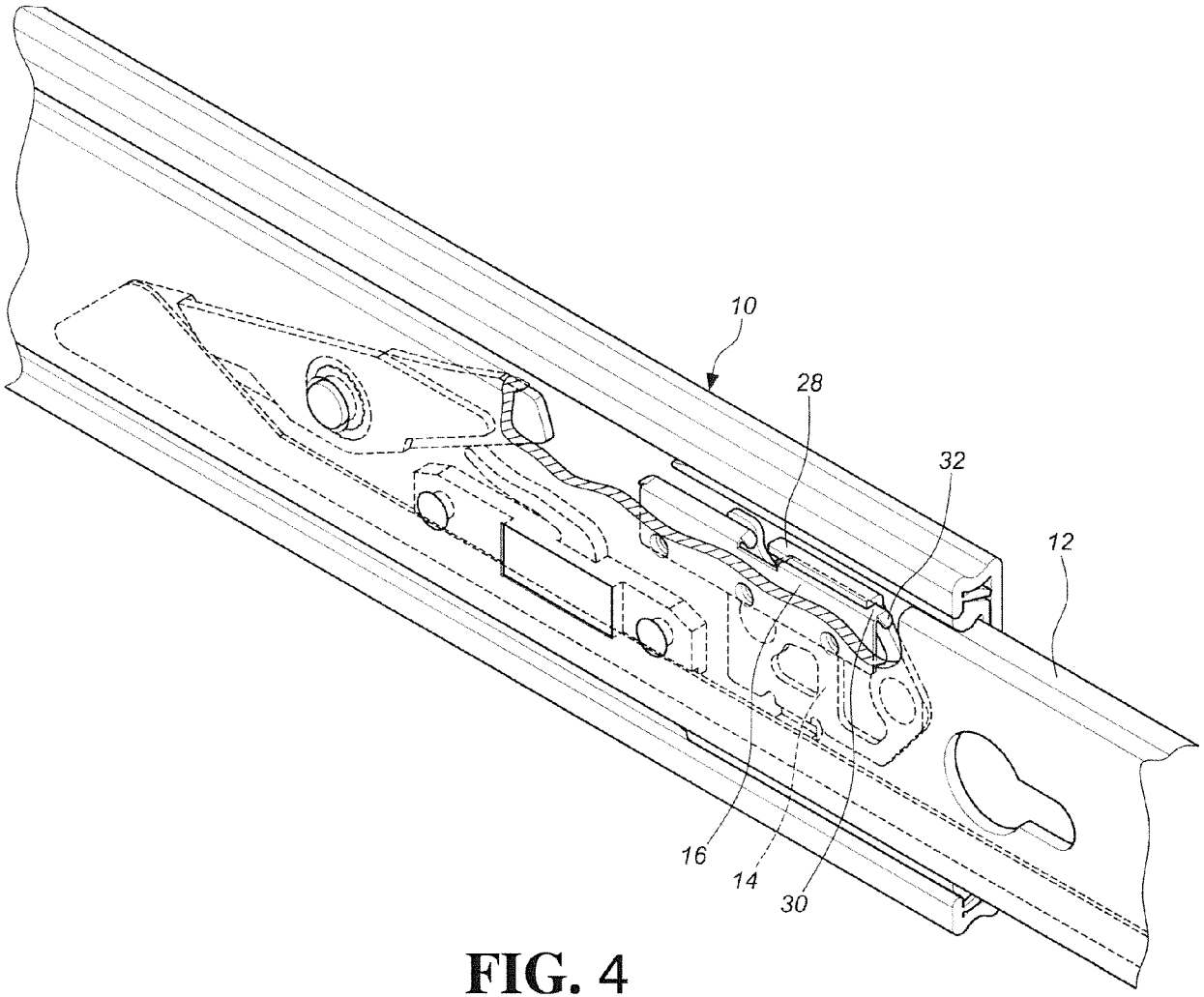
FIG. 4 shows that the deceleration device is at the second position where the friction member overlaps with the stop member.
Figure 5:
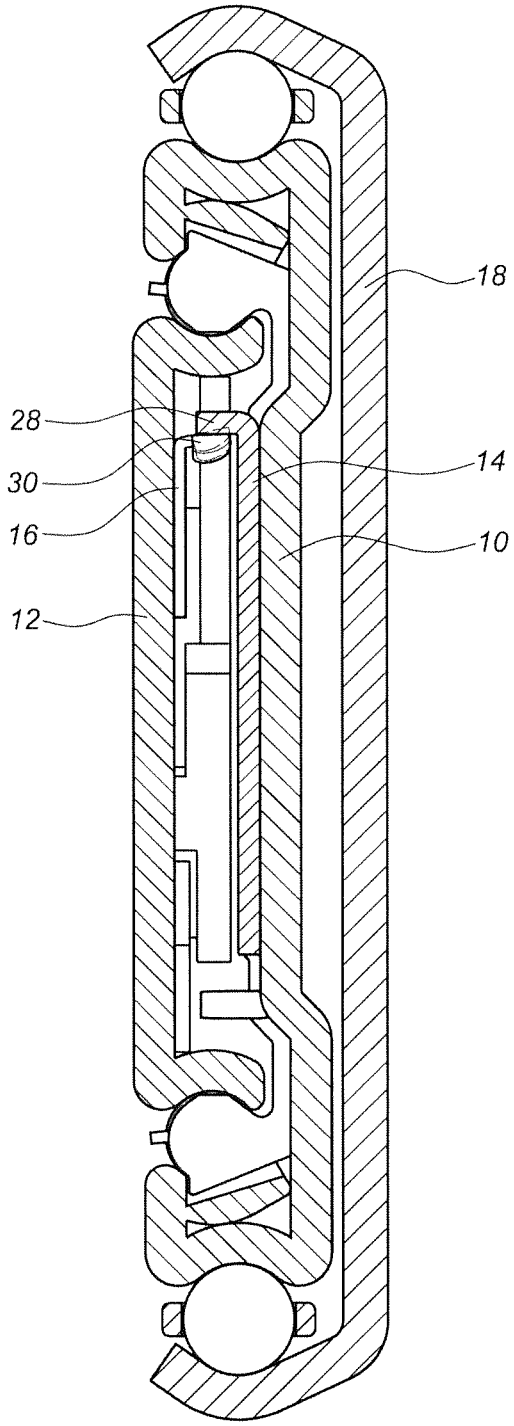
FIG. 5 shows that the friction member of the deceleration device is bent and flexibly in contact with the stop plate.

As shown in FIGS. 1 and 3, when the second rail 12 is moved (such as retraction or extension) relative to the first rail 10, the second rail 12 freely slide relative to the first rail 10 until the friction member 16 touches the stop plate 28 of the stop member 14 by the guide face 32 (shown in FIG. 3). Then the second rail 12 is continuously moved, so that the friction member 16 overlaps the stop member 14 by the guide face 32 (shown in FIG. 4). More specifically, as the guide face 32 of the friction member 16 touches the stop plate 28 of the stop member 14, an initial friction is generated between the friction member 16 and the stop member 14. Then, more friction forces between the friction member 16 and the stop member 14 are generated as the more areas that the friction member 16 contacts the stop member 14, when the friction member 16 overlaps the stop member 14. Under this circumstance, as shown in FIGS. 4 and 5, the extension portion 30 of the friction member 16 is slidably and flexibly in contact with the stop plate 28 of the stop member 14 so as to provide a friction between the friction member 16 and the stop member 14. Therefore, when the second rail 12 is pulled or pushed relative to the first rail 10, a resistance effect caused by the friction between the friction member 16 and the stop member 14 is generated to decelerate the movement of the second rail 12.

When the second rail 12 is further extended relative to the first rail 10 after the friction member 16 overlaps the stop member 14, by the engagement between the stop plate 28 and the engaging member 20, the second rail 12 can be fully extended relative to the first rail 10 and does not disengage from the first rail 10. In the meanwhile, the guide face 32 on the end of the friction member 16 contacts the stop plate 28 as shown in FIG. 2 so as to temporarily position the second rail 12 relative to the first rail 10 to prevent the second rail 12 from being easily retracted into the first rail 10.

The deceleration device comprising a stop member 14 and a friction member 16 reduces the slide speed of the rail when the rail is pulled to the final position so as to reduce the impact noise and increase the reliability of the operation of the slide assembly. On the other hand, when the user pulls the rail to the fully extended position, the deceleration device generates a resistance effect, so that the user can acknowledge that the rail is almost pulled to the fully extended position. It is noted that the deceleration device can be mounted on different positions of the slide assembly in accordance with the requirement of the user, and is not limited by the preferred embodiment of the present invention.

While we have shown and described the embodiment in accordance with the present invention, it should be clear to those skilled in the art that further embodiments may be made without departing from the scope of the present invention.

What is claimed is:

1. A slide assembly comprising:

a longitudinally extended first rail having two sidewalls and a connection wall connected between the two sidewalls;

a second rail slidably connected to the first rail and located between the two sidewalls for longitudinal displacement relative to the first rail;

a stop member fixed to the connection wall and having a stop plate, the stop plate being substantially perpendicular to the connection wall of the first rail; and a friction member fixed to the second rail and having at least one extension portion which is located corresponding to the stop plate of the stop member, the extension portion having a guide face formed on each of a pair of opposite ends of the extension portion, each guide face extending longitudinally outward and downwardly from a respective end of the extension portion, responsive to the second rail being moved longitudinally relative to the first rail in either of two opposing directions, a corresponding guide face followed by the extension portion of the friction member frictionally contacts the stop plate to provide resistance to movement therebetween and thereby decelerates the motion of the second rail relative to the first rail.

2. The slide assembly as claimed in claim 1, wherein the friction member has multiple extension portions.

3. The slide assembly as claimed in claim 1, further comprising an engaging member which is pivotably connected to the second rail, a linkage member movably connected to the second rail and located corresponding to the engaging member, the linkage member moves linearly to push the engaging member to swing.

4. The slide assembly as claimed in claim 3, further comprising a resilient member which contacts the engaging member to maintain the engaging member to be partially located corresponding to the stop plate of the stop member.

* * * * *